US007111438B2

(12) United States Patent
Arima

(10) Patent No.: US 7,111,438 B2
(45) Date of Patent: Sep. 26, 2006

(54) PACKAGING APPARATUS AND PACKAGING METHOD

(75) Inventor: Shinichi Arima, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/891,068

(22) Filed: Jul. 15, 2004

(65) Prior Publication Data

US 2005/0011162 A1 Jan. 20, 2005

(30) Foreign Application Priority Data

Jul. 16, 2003 (JP) ..... 2003-197804

(51) Int. Cl.
*B65B 13/02* (2006.01)
*B65B 41/16* (2006.01)
*B65B 11/04* (2006.01)

(52) U.S. Cl. ..... 53/399; 53/441; 53/556; 53/587; 53/389.4; 242/552

(58) Field of Classification Search ..... 53/399, 53/441, 556, 587, 389.1–389.4; 242/552
See application file for complete search history.

(56) References Cited

U.S. PATENT DOCUMENTS 4,177,959 A * 12/1979 Lancaster et al. ..... 242/555.1
4,603,800 A * 8/1986 Focke et al. ..... 242/417.2
5,411,223 A * 5/1995 Gatteschi ..... 242/551
5,716,022 A * 2/1998 Chiloff ..... 242/552
6,553,746 B1 * 4/2003 Cere' ..... 53/589
6,676,062 B1 * 1/2004 Herhaus ..... 242/417

FOREIGN PATENT DOCUMENTS

DE 19601668 A * 7/1997
JP 59078060 A * 5/1984
JP 5-97123 A 4/1993

OTHER PUBLICATIONS

PTO 06/2282, English language translation of JP 59078060, Feb. 2006.*
PTO 06/2283, English language translation of DE 19601668, Feb. 2006.*

* cited by examiner

*Primary Examiner*—Stephen F. Gerrity
(74) *Attorney, Agent, or Firm*—Sughrue Mion, PLLC

(57) ABSTRACT

In a packaging apparatus, when replacing a preceding single-faced corrugated fiberboard (wrapping material) with a subsequent single-faced corrugated fiberboard, a draw-out roller is operated such that the preceding single-faced corrugated fiberboard is drawn out to its trailing end. At this time, a reserve roller, around which the single-faced corrugated fiberboard is trained, is moved such that the single-faced corrugated fiberboard, which has been drawn out, is accumulated thereat. Then, the trailing end of the preceding single-faced corrugated fiberboard and a leading end of the subsequent single-faced corrugated fiberboard are joined together at a joining device. In this way, the preceding single-faced corrugated fiberboard can be used up until its final end, and thus there is no waste of the single-faced corrugated fiberboard.

2 Claims, 9 Drawing Sheets

PACKAGING APPARATUS AND PACKAGING METHOD

CROSS-REFERENCE TO RELATED APPLICATION

This application claims priority under 35 USC 119 from Japanese patent application, No. 2003-197804, the disclosure of which is incorporated by reference herein.

BACKGROUND OF THE INVENTION

1. Field of the Invention

The present invention relates to a packaging apparatus and a packaging method for wrapping a packaging material around side surfaces of a loaded object which is loaded on a pallet.

2. Description of the Related Art

As shown in FIG. 9, in a conventional packaging apparatus 100 for planographic printing plates, a single-faced corrugated fiberboard 102 is drawn out by nip rollers 112 from a single-faced corrugated fiberboard roll 102A which is wound up in the shape of a roll. The single-faced corrugated fiberboard 102 is wrapped on the side surfaces of a stack 106 of planographic printing plates which are sealed by inner packaging paper and are stacked on a pallet 110 on a turntable 108A of a wrapping device 108.

In such a packaging apparatus 100, it is difficult in light of the mechanisms of the wrapping device 108 to stop the wrapping operation carried out by the wrapping device 108, after the preceding single-faced corrugated fiberboard 102 is completely drawn out from the preceding single-faced corrugated fiberboard roll 102A, and join together, with a joining device 116, of the trailing end of the preceding single-faced corrugated fiberboard 102 and the leading end of a subsequent single-faced corrugated fiberboard 104.

Therefore, when the length of the single-faced corrugated fiberboard 102 wound around the single-faced corrugated fiberboard roll 102A becomes shorter than the length needed to wrap around the stack 106, the single-faced corrugated fiber board 102 is cut by a cutter 114 and the trailing end of the preceding single-faced corrugated fiberboard 102 is joined to the leading end of the subsequent single-faced corrugated fiberboard 104. However, with this method, a significant amount of the single-faced corrugated fiberboard 102 is wasted without being used, which results in wasting resources.

A conventional device has been conceived of, which connects the trailing end of a preceding packaging material with the leading end of a subsequent packaging material (see, for example, Japanese Patent Application Laid-Open (JP-A) No. 5-97123). In this device disclosed in JP-A No. 5-97123, when the object to be packaged is small, the packaging material is reliably prevented from running out during the wrapping thereof. However, in this device, when the object to be packaged is large, there is a possibility that the packaging material runs out during wrapping and there arise problems similar to those of the packaging apparatus 100.

SUMMARY OF THE INVENTION

In view of the aforementioned, an object of the present invention is, when a preceding packaging material is to be replaced by a subsequent packaging material, to use up the preceding packaging material to the end thereof so that the packaging material is not wasted.

In a first aspect of the present invention, a packaging apparatus comprises: a draw-out roller drawing-out a packaging material from a packaging material roll in which the packaging material is wound-up in a form of a roll; an accumulating roller around which the packaging material drawn out by the draw-out roller is trained; moving means for moving the accumulating roller at a time when the packaging material roll is to be replaced, and accumulating the packaging material at the accumulating roller; and a wrapping device for pulling-out the packaging material which is trained on the accumulating roller, and wrapping the packaging material around side surfaces of a loaded object which is loaded on a pallet.

In the packaging apparatus based on this aspect, when the packaging material roll is to be replaced, the accumulating roller, on which the packaging material is trained, is moved by the moving means. The preceding packaging material, which has been drawn out from the packaging material roll by the draw-out roller, is accumulated at the accumulating roller. In this way, the preceding packaging material, which is drawn out at the time of replacing the packaging material roll, is accumulated at the accumulating roller without bending and without being scratched.

In the packaging apparatus of the present aspect, the preceding packaging material is drawn out from the packaging material roll and is joined to the subsequent packaging material, and immediately thereafter, wrapping of the packaging material onto the side surfaces of the loaded object loaded on a pallet can be carried out by the wrapping device. Accordingly, the preceding packaging material can be used up to the end without waste.

In a second aspect of the present invention, the accumulating roller of the packaging apparatus is provided so as to be oriented vertically.

In the packaging apparatus based on the present aspect, the accumulating roller is provided so as to be oriented vertically, and the packaging material is trained around so as to be oriented vertically. Therefore, the packaging material, which is conveyed while oriented vertically, does not bend due to its own weight.

In a third aspect of the present invention, the packaging apparatus further comprises control means for stopping the accumulating roller and the draw-out roller when, after stopping of the wrapping device, a preceding packaging material is drawn out from the packaging material roll by the draw-out roller while being accumulated at the accumulating roller and a trailing end of the preceding packaging material is drawn out to a joining position at which the trailing end of the preceding packaging material is joined together with a leading end of a subsequent packaging material.

In the packaging apparatus based on the present aspect, after stopping of the wrapping device, the preceding packaging material is drawn out from the packaging material roll by the draw-out roller while being accumulated at the accumulating roller which is moving. Then, when the trailing end of the preceding packaging material is drawn out to the joining position at which the trailing end of the preceding packaging material is joined with the leading end of the subsequent packaging material, the accumulating roller and the draw-out roller are stopped by the control means. In this way, the trailing end of the preceding packaging material and the leading end of the subsequent packaging material can be joined together. Further, the preceding packaging material can be used up to the end without waste.

In a fourth aspect of the present invention, a joining device, which joins together the trailing end of the preceding packaging material which has been drawn out and the leading end of the subsequent packaging material, is provided at the joining position.

In accordance with the present aspect, the trailing end of the preceding packaging material and the leading end of the subsequent packaging material are joined together by the joining device at the joining position. Therefore, the packaging material can be supplied continuously.

In a fifth aspect of the present invention, the packaging apparatus has, between the accumulating roller and the wrapping device, a tension applying roller for applying tension to the packaging material, and restraining means for restraining movement of the tension applying roller.

In accordance with the present aspect, between the accumulating roller and the wrapping device, tension is applied to the packaging material by the tension applying roller. Therefore, wrinkles do not form in the packaging material at the time when the packaging material is wrapped around the loaded object at the wrapping device.

Further, because movement of the tension applying roller is restrained by the restraining means, slack does not arise and wrinkles do not form when the packaging material is being accumulated at the accumulating roller.

In a sixth aspect of the present invention, after a trailing end of a preceding packaging material and a leading end of a subsequent packaging material have been joined together, a control means releases restraining of a tension applying roller by a restraining means, and drives the wrapping device, and releases restraining of the accumulating roller by the moving means when the tension applying roller is moved past a predetermined position due to tension of the packaging material, and restrains the accumulating roller when the accumulating roller is moved to a predetermined position due to the packaging material, which has been accumulated, being drawn out.

In accordance with the present aspect, after the trailing end of the preceding packaging material and the leading end of the subsequent packaging material have been joined together, the control means releases the restraining of the tension applying roller by the restraining means.

Next, when the wrapping device is driven and the tension applying roller is moved past a predetermined position due to the tension of the packaging material, the restraining of the accumulating roller by the moving means is released by the control means.

When the accumulating roller moves to a predetermined position due to the packaging material, which has been accumulated at the accumulating roller, being drawn out, movement of the accumulating roller is restrained by the control means. In this way, the accumulating roller and the tension applying roller are positioned in the state at the time of usual wrapping, and immediately thereafter, the subsequent packaging material can be wrapped on the side surfaces of the loaded object.

In a seventh aspect of the present invention, a packaging method for drawing a packaging material out from a packaging material roll in which the packaging material is wound-up in a form of a roll, and wrapping the packaging material around side surfaces of a loaded object which is loaded on a pallet, comprises: when the packaging material roll is to be replaced, drawing a preceding packaging material out from the packaging material roll; and increasing an amount of the drawn-out packaging material accumulated on an accumulating roller on which the packaging material, which has been drawn out, is trained, by moving the accumulating roller.

According to the present aspect, when the packaging material roll is to be replaced, the accumulating roller is moved such that an amount of the drawn-out preceding packaging material accumulated on an accumulating roller on which the packaging material, which has been drawn out, is trained is increased. The drawn-out packaging material can thereby be accumulated without bending or being scratched.

Further, in accordance with the present aspect, the preceding packaging material is drawn out from the packaging material roll, and is joined to the subsequent packaging material, and immediately thereafter the packaging material can be wrapped around the side surfaces of the loaded object which is loaded on a pallet. Therefore, the preceding packaging material can be used without waste.

DETAILED DESCRIPTION OF THE INVENTION

An embodiment of the present invention will be described hereinafter with reference to the drawings.

Figure 1:
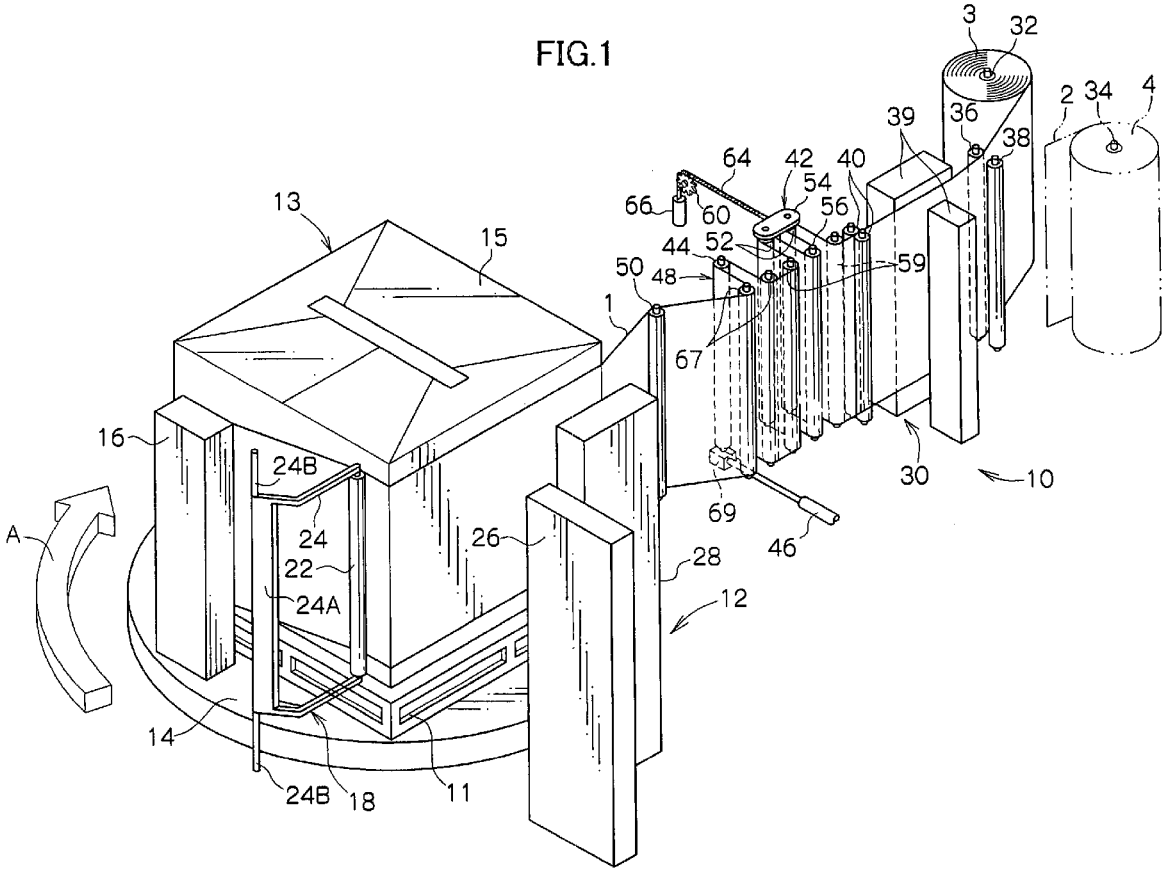
FIG. 1 is a perspective view showing a packaging apparatus relating to an embodiment of the present invention.

As shown in FIG. 1, in a packaging apparatus 10 relating to the present embodiment, a single-faced corrugated fiberboard 1 is drawn out from a single-faced corrugated fiberboard roll 3, or a single-faced corrugated fiberboard 2 is drawn out from a single-faced corrugated fiberboard roll 4, and is wrapped around the side surfaces of a stack 13 set on a pallet 11. (The single-faced corrugated fiberboard 1 or 2 is wound around once or twice.) The side surfaces of the stack 13 are protected thereby.

Figure 2:
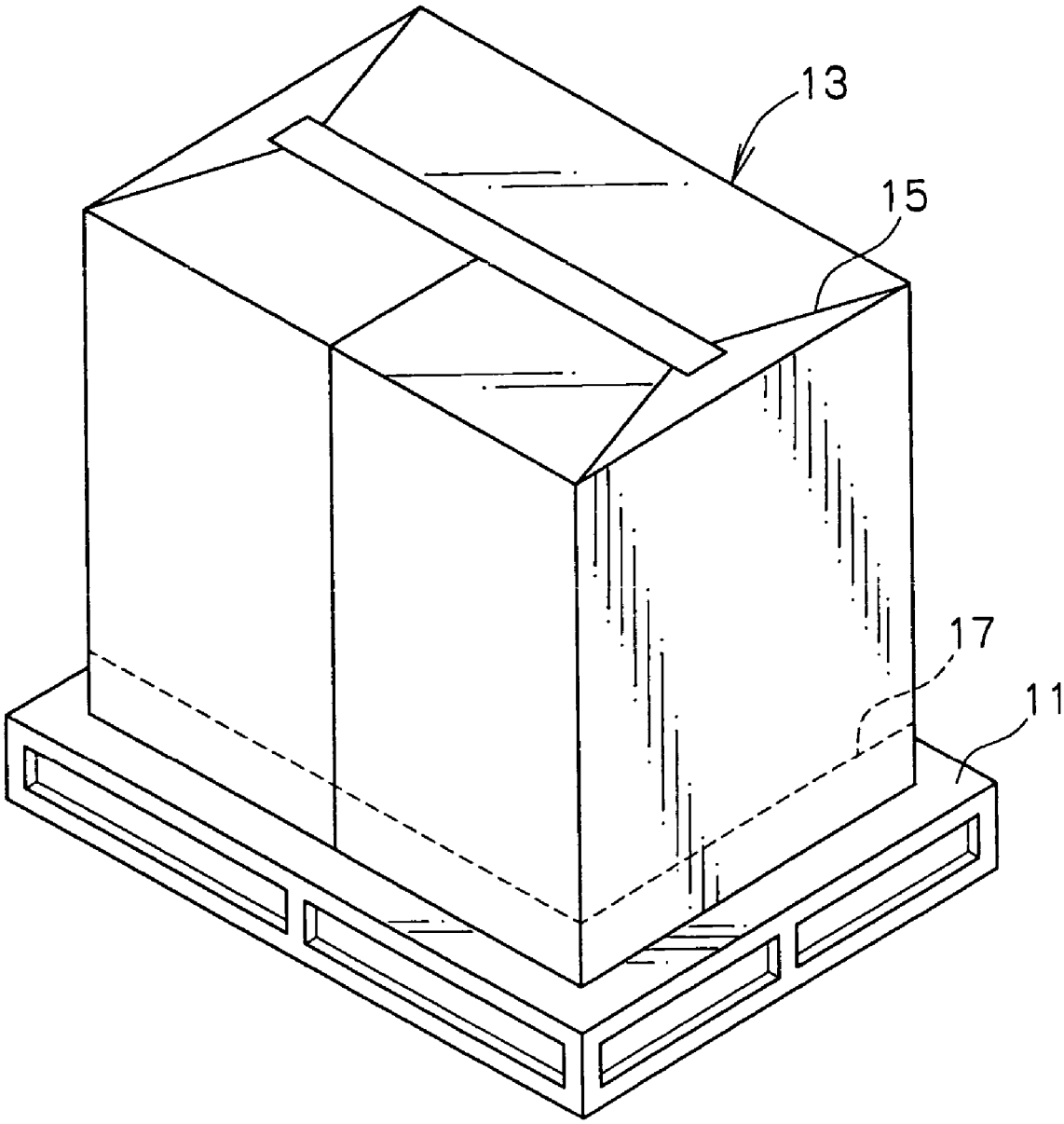
FIG. 2 is a perspective view showing a stack around whose side surfaces a single-faced corrugated fiberboard is wrapped by the packaging apparatus relating to the embodiment.

As shown in FIG. 2, the stack 13 is formed by a bundle of plural planographic printing plates being placed on a plate 17 which is formed of vinyl chloride and sealed by an inner packaging paper 15, and is and set on the pallet 11.

In order to protect the stack 13 from moisture and to shield the stack 13 from the light and the like, kraft paper in which aluminum foils are adhered together by polyethylene, kraft paper in which nylon or PET on which aluminum is vapor-deposited are adhered together by polyethylene, black polyethylene film in which carbon is mixed in, or the like can be used for the inner packaging paper 15.

As shown in FIG. 1, the packaging apparatus 10 has a wrapping device 12 which pulls the preceding single-faced corrugated fiberboard 1 out from the single-faced corrugated fiber board roll 3, and wraps it around the side surfaces of the stack 13. Here, explanation will be given by using the single-faced corrugated fiberboard 1 as an example, but the single-faced corrugated fiberboard 2 is wrapped in the same way.

A circular turntable 14 is provided at the wrapping device 12. The pallet 11 on which the stack 13 is loaded is set on the turntable 14, and the turntable 14 is turned clockwise (in the direction of arrow A in the drawing) by an unillustrated turning device. A first leading end holding device 16, which holds the leading end of the single-faced corrugated fiberboard 1, stands erect on the turntable 14 with a gap between the first leading end holding device 16 and the side surface of the stack 13.

The first leading end holding device 16 is a chamber which is shaped as a rectangular column and is hollow. The interior of the first leading end holding device 16 is made to be a vacuum by an unillustrated vacuum device. A large number of suction holes (not shown) are formed in the surface of the first leading end holding device 16 which surface faces the side surface of the stack 13. In this way, the leading end of the single-faced corrugated fiberboard 1 can be sucked, and when the turntable 14 is turned, the single-faced corrugated fiberboard 1 is drawn out from the single-faced corrugated fiberboard roll 3 and wrapped around the side surfaces of the stack 13.

A slack removing device 18 is provided which, when the turntable 14 is turned, makes the single-faced corrugated fiberboard 1 fit tightly to the side surfaces of the stack 13, so as to remove the slack in the wrapped single-faced corrugated fiberboard 1.

The slack removing device 18 is structured by a slack removing roller 22 and a U-shaped arm 24 which rotatably supports the both axial direction end portions of the slack removing roller 22. Shaft portions 24B, which are rotatably supported by bearings provided at the outer side of the turntable 14, are formed at the both end portions of a base shaft 24A of the arm 24. The arm 24 swings around the shaft portions 24B due to an unillustrated air cylinder, and presses the slack removing roller 22 against the side surface of the stack 13.

When the turntable 14 is turned one time and the single-faced corrugated fiberboard 1 is wrapped one time around the side surfaces of the stack 13, a second leading end holding device 28 holds the single-faced corrugated fiberboard 1. Here, a cutting-joining device 26 cuts the single-faced corrugated fiberboard 1, and adheres it to the side surface of the stack 13 by an adhesive material such as tape, a hot melt adhesive, or the like.

Figure 5:
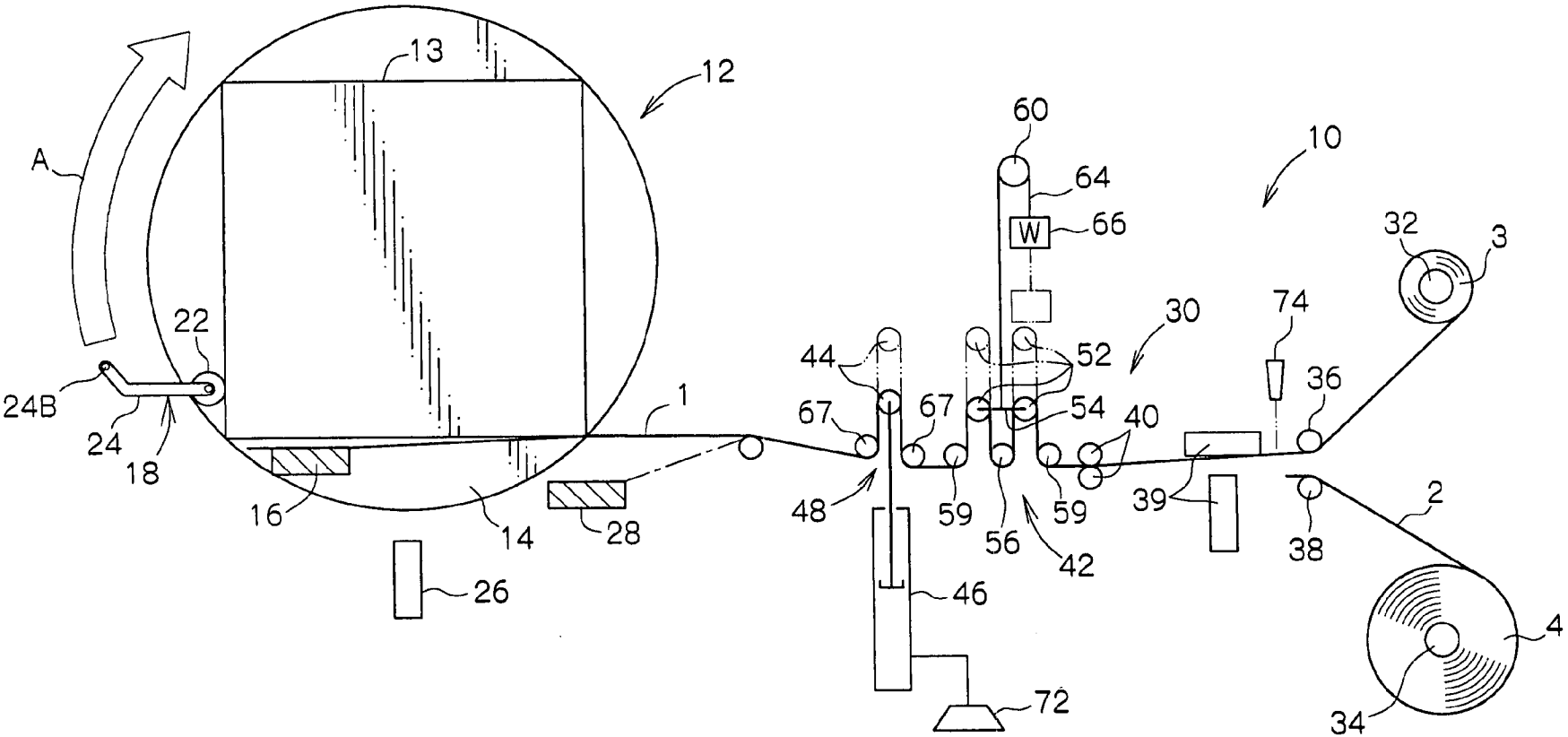
FIG. 5 is a schematic diagram showing the packaging apparatus relating to the embodiment.

Further, as shown in FIG. 5, when the wrapping device 12 is stopped, the second leading end holding device 28 holds the leading end of the single-faced corrugated fiberboard 1 (as shown by the chain line in the figure), and when turning of the wrapping device 12 starts, the second leading end holding device 28 transfers the leading end of the single-faced corrugated fiberboard 1 to the first leading end holding device 16. Note that, in the same way as the first leading end holding device 16, the second leading end holding device 28 is a vacuum chamber which is shaped as a rectangular column, and sucks and holds the leading end of the single-faced corrugated fiberboard 1.

Next, a supplying mechanism 30, which conveys the single-faced corrugated fiberboard 1 from the single-faced corrugated fiberboard roll 3 to the wrapping device 12 in a state in which the single-faced corrugated fiberboard 1 is oriented vertically, will be described.

As shown in FIG. 1, a draw-out shaft 32 and a draw-out shaft 34, at which the single-faced corrugated fiberboard rolls 3, 4 are installed, are provided so as to be oriented vertically in the supplying mechanism 30. The peripheral surfaces of the draw-out shaft 32 and the draw-out shaft 34 are subjected to powder braking processing, such that the cores slide and the drawn-out single-faced corrugated fiberboards 1, 2 do not go slack.

A guide roller 36, which guides the single-faced corrugated fiberboard 1, and a guide roller 38, which guides the single-faced corrugated fiberboard 2, are provided so as to be oriented vertically and so as to face one another, at the downstream side of the draw-out shaft 32 and the draw-out shaft 34. Further, draw-out rollers 40, which are driven by an unillustrated motor and which nip the single-faced corrugated fiberboards 1, 2 and draw them out from the single-faced corrugated fiberboard rolls 3, 4, are provided so as to be oriented vertically at the downstream side of the guide rollers 36, 38.

A joining device 39, which joins the single-faced corrugated fiberboard 1 and the single-faced corrugated fiberboard 2 by tape or an adhesive, is disposed between the draw-out rollers 40 and the guide rollers 36, 38. A reserve mechanism 42, which will be described later and at which the single-faced corrugated fiberboard 1 is accumulated, is provided at the downstream side of the draw-out rollers 40. (Hereinafter, explanation will be given by using the single-faced corrugated fiberboard 1 as an example.)

A dancer roller 44 serving as a tension applying mechanism 48 is disposed between two path rollers 67 at the downstream side of the reserve mechanism 42. A supporting plate 69, which pivotally supports the dancer roller 44, is supported at an air cylinder 46, and applies tension to the single-faced corrugated fiberboard 1 by adjusting the air pressure. Further, a holding brake 72, which restrains movement of the rod of the air cylinder 46, is provided at the tension applying mechanism 48.

The reserve mechanism 42 will now be described.

Figure 3:
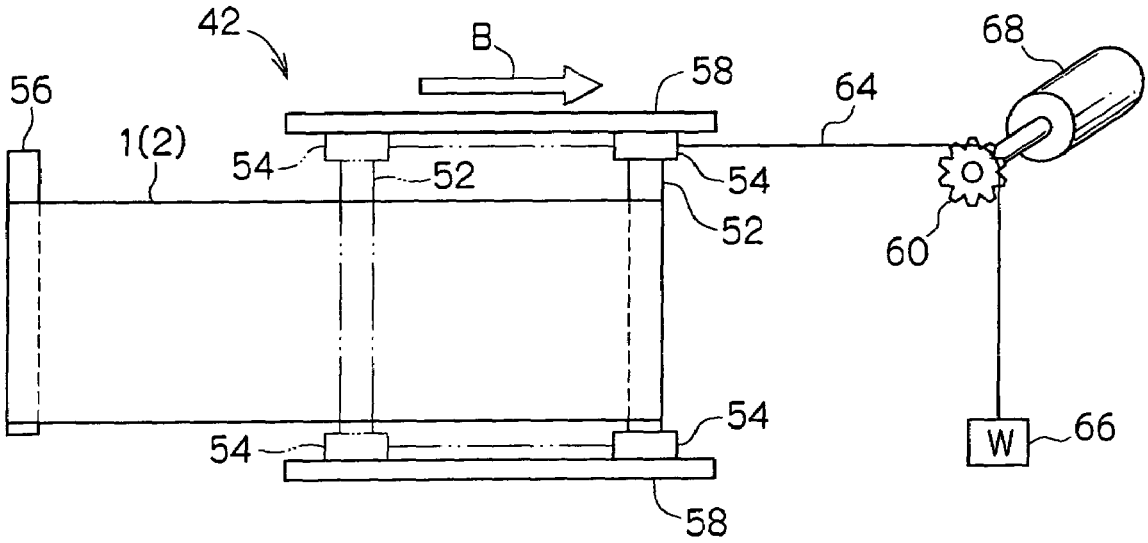
FIG. 3 is a schematic diagram showing a reserve mechanism of the packaging apparatus relating to the embodiment.

As shown in FIGS. 1 and 5, both axial direction end portions of a pair of reserve rollers 52 of the reserve mechanism 42, which is provided between path rollers 59, are connected by connecting plates 54 so as to be freely rotatable. As shown in FIG. 3, the connecting plates 54 are supported, so as to be movable in the direction of arrow B, by rails 58 disposed above and below. A sprocket 60 is rotatably mounted to a mounting plate (not illustrated) on an imaginary extension of the rail 58.

One end portion of a timing belt 64, which meshes with the teeth of the sprocket 60, is attached to the connecting plate 54. A weight 66 is attached to the other end portion of the timing belt 64. An electromagnetic brake 68, which stops rotation of the sprocket 60 or allows the sprocket 60 to rotate freely, is provided.

Figure 4:
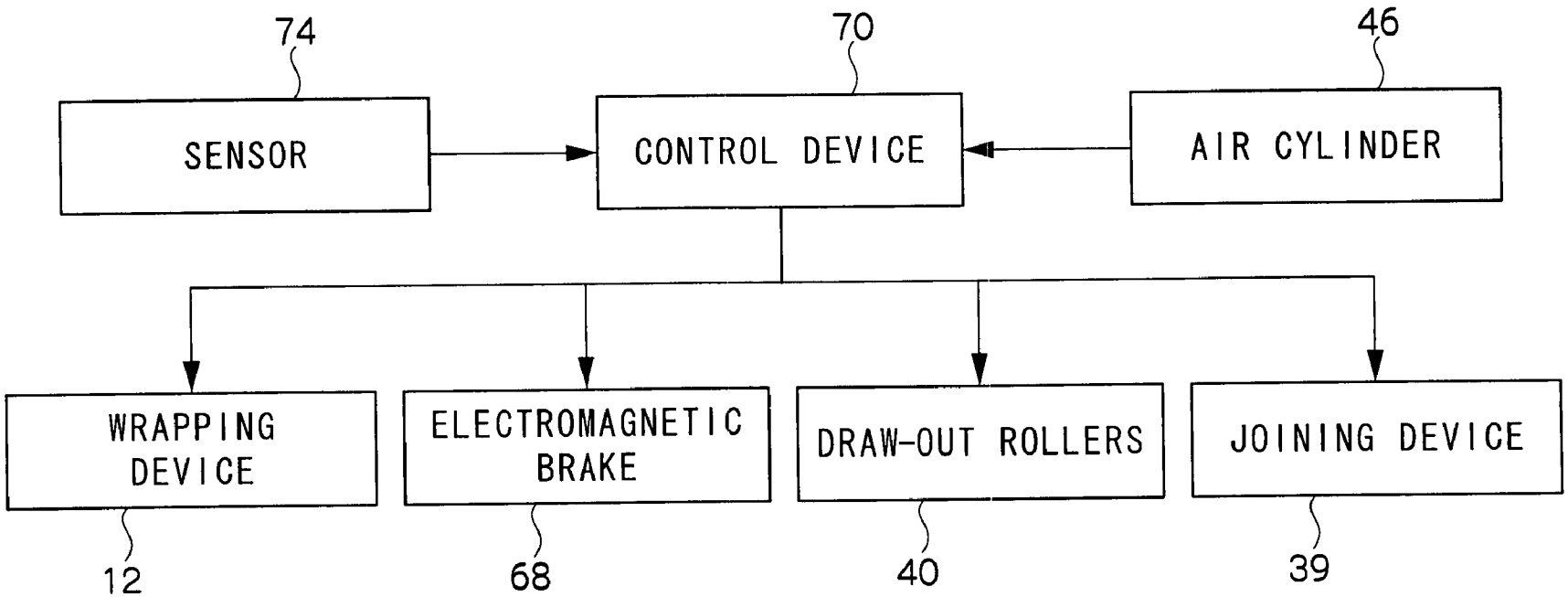
FIG. 4 is a block diagram showing a control device of the packaging apparatus relating to the embodiment.

When the electromagnetic brake 68 is released by a control device 70 (see FIG. 4), the sprocket 60 becomes able to rotate, the weight 66 drops due to its own weight, the connecting plate 54 is pulled by the timing belt 64 and moves in the direction of arrow B, and the single-faced corrugated fiberboard 1 accumulates between a fixed roller 56 and the reserve rollers 52.

Here, explanation will be given of the flow from the time that wrapping by the preceding single-faced corrugated fiberboard 1 is carried out to the time of switching to wrapping by the subsequent single-faced corrugated fiberboard 2.

First, as shown in FIG. 5, the turntable 14 is turned by the control device 70 (see FIG. 4) in the state in which the leading end of the preceding single-faced corrugated fiberboard 1 is held by the first leading end holding device 16. In this way, the single-faced corrugated fiberboard 1 is pulled out from the single-faced corrugated fiberboard roll 3, and is wrapped on the side surfaces of the stack 13. Then, when the single-faced corrugated fiberboard 1 has been wrapped one time around the side surfaces of the stack 13, the cutting-joining device 26 is operated by the control device 70 (see FIG. 4).

In this way, the single-faced corrugated fiberboard 1 is held by the second leading end holding device 28 and is cut, and this end portion is joined by tape or an adhesive to the leading end held at the first leading end holding device.

At this time, the air cylinder 46 pushes the dancer roller 44 to contact the single-faced corrugated fiberboard 1, and applies tension to the single-faced corrugated fiberboard 1. The single-faced corrugated fiberboard 1 is thereby wrapped around the side surfaces of the stack 13 without going slack. Note that the rotating speed of the draw-out rollers 40 which feed the single-faced corrugated fiberboard 1 out is adjusted such that the dancer roller 44 is positioned at a predetermined position due to the reaction force received from the single-faced corrugated fiberboard 1.

The electromagnetic brake 68 is operated by the control device 70 (see FIG. 4), and restrains movement of the reserve rollers 52 at positions near the fixed roller 56.

Figure 6:
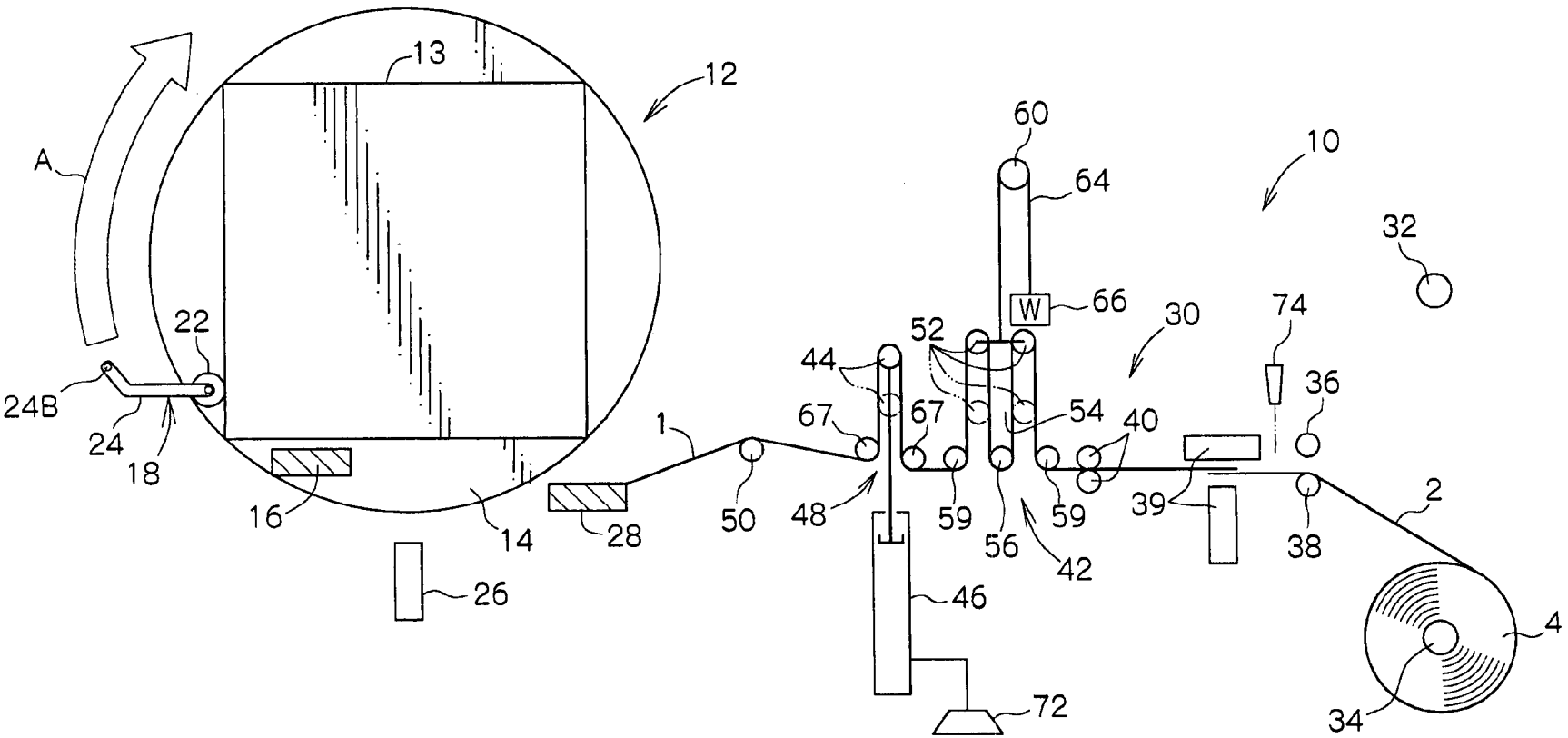
FIG. 6 is another schematic diagram showing the packaging apparatus relating to the embodiment.

In place of the stack 13 around which the single-faced corrugated fiberboard 1 has been wrapped, a stack 13 around which the single-faced corrugated fiberboard 1 has not yet been wrapped is set on the turntable 14, and in the same way, the single-faced corrugated fiberboard 1 is wrapped around the side surfaces of this stack 13. When it is detected that, while repeating the wrapping process, the remaining length of the single-faced corrugated fiberboard 1 is less than the length needed to be wrapped around the side surfaces of the stack 13, as shown in FIG. 6, first, the holding brake 72 operates so as to stop the air cylinder 46 at a predetermined position and restrain the dancer roller 44.

Then, by the control device 70 (see FIG. 4), the draw-out rollers 40 are driven and the electromagnetic brake 68 is released. In this way, the single-faced corrugated fiberboard 1 is drawn out from the single-faced corrugated fiberboard roll 3 by the draw-out rollers 40, and the reserve rollers 52 are moved in the direction of moving away from the fixed roller 56 (the direction of arrow B in the drawing) due to the weight of the weight 66.

At this time, because the single-faced corrugated fiberboard 1 which is drawn out is accumulated in a state of being trained around the reserve rollers 52, the single-faced corrugated fiberboard 1 does not fold over due to its own weight, and is not damaged. Note that an air cylinder may be employed in place of the weight 66.

Then, the trailing end of the drawn-out single-faced corrugated fiberboard 1 is detected by a sensor 74. When the trailing end of the single-faced corrugated fiberboard 1 is drawn out to the position of the joining device 39, the control device 70 (see FIG. 4), on the basis of the detection signal of the sensor 74, stops the driving of the draw-out rollers 40, and operates the electromagnetic brake 68 so as to restrain the reserve rollers 52. Then, the joining device 39 is driven by the control device 70 (see FIG. 4), such that the leading end of the subsequent single-faced corrugated fiberboard 2, which is drawn out to the position of the joining device 39, and the trailing end of the preceding single-faced corrugated fiberboard 1 are joined together.

Figure 7:
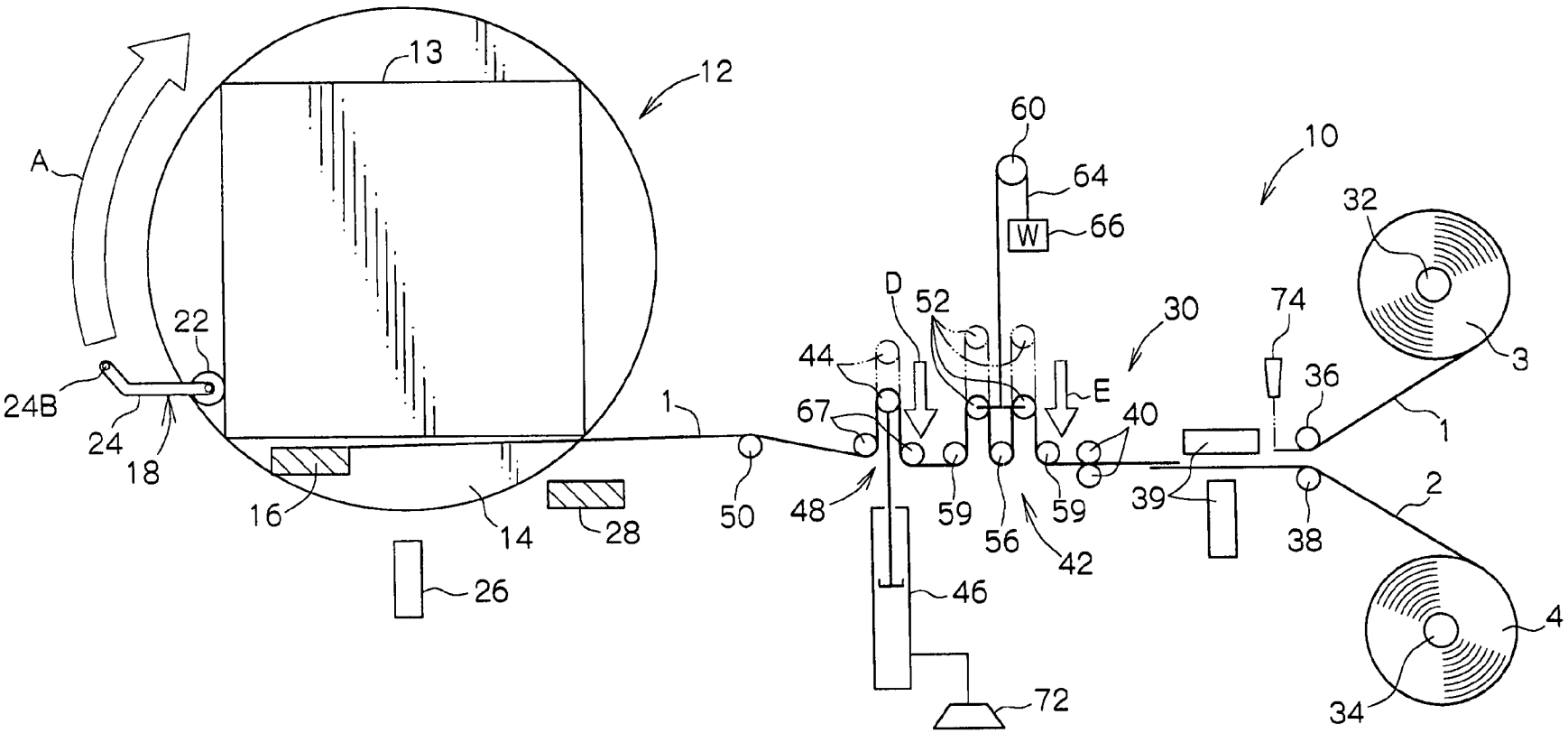
FIG. 7 is a schematic diagram showing the packaging apparatus relating to the embodiment.

Then, after the trailing end of the preceding single-faced corrugated fiberboard 1 and the leading end of the subsequent single-faced corrugated fiberboard 2 have been joined together, as shown in FIG. 7, by the control device 70 (see FIG. 4), the turntable 14 is rotated, and the air cylinder 46 is operated such that restraining of the dancer roller 44 is cancelled. Further, the draw-out rollers 40 are driven.

The dancer roller 44 is moved, by the tension of the single-faced corrugated fiberboard 1, in the direction resisting the urging force of the air cylinder 46 (i.e., in the direction of arrow D in the drawing). Then, when the dancer roller 44 has moved to the predetermined position illustrated by the solid line in the drawing, the electromagnetic brake 68 is released by the control device 70 (see FIG. 4).

Here, the tension which the dancer roller 44 applies to the single-faced corrugated fiberboard 1 is greater than the tension which is applied to the single-faced corrugated fiberboard 1 due to the reserve rollers 52 being pulled by the weight 66. Therefore, due to the tension of the single-faced corrugated fiberboard 1, the reserve rollers 52 move in the direction of approaching the fixed roller 56 (the direction of arrow E in the drawing) against the tension of the weight 66.

Then, when the reserve rollers 52 have moved to the predetermined positions shown by the solid lines in the drawing, the electromagnetic brake 68 is operated by the control device 70 (see FIG. 4), and movement of the reserve rollers 52 is restrained. The reserve rollers 52 and the dancer roller 44 thereby return to their states at the time of usual wrapping. Therefore, wrapping of the stack 13 by the single-faced corrugated fiberboard 2 can be carried out immediately thereafter.

In this way, at the time when the single-faced corrugated fiberboard roll 3 is replaced by the single-faced corrugated fiberboard roll 4, the preceding single-faced corrugated fiberboard 1 is drawn out to its trailing end from the single-faced corrugated fiberboard roll 3, and the reserve rollers 52 are moved so as to accumulate the drawn-out single-faced corrugated fiberboard 1 at the reserve rollers 52. Therefore, the preceding single-faced corrugated fiberboard 1 can be used up to the end thereof without any remaining, and there is no waste of the single-faced corrugated fiberboard 1. Further, the drawn-out single-faced corrugated fiberboard 1 does not fold over or become damaged.

Figure 8:
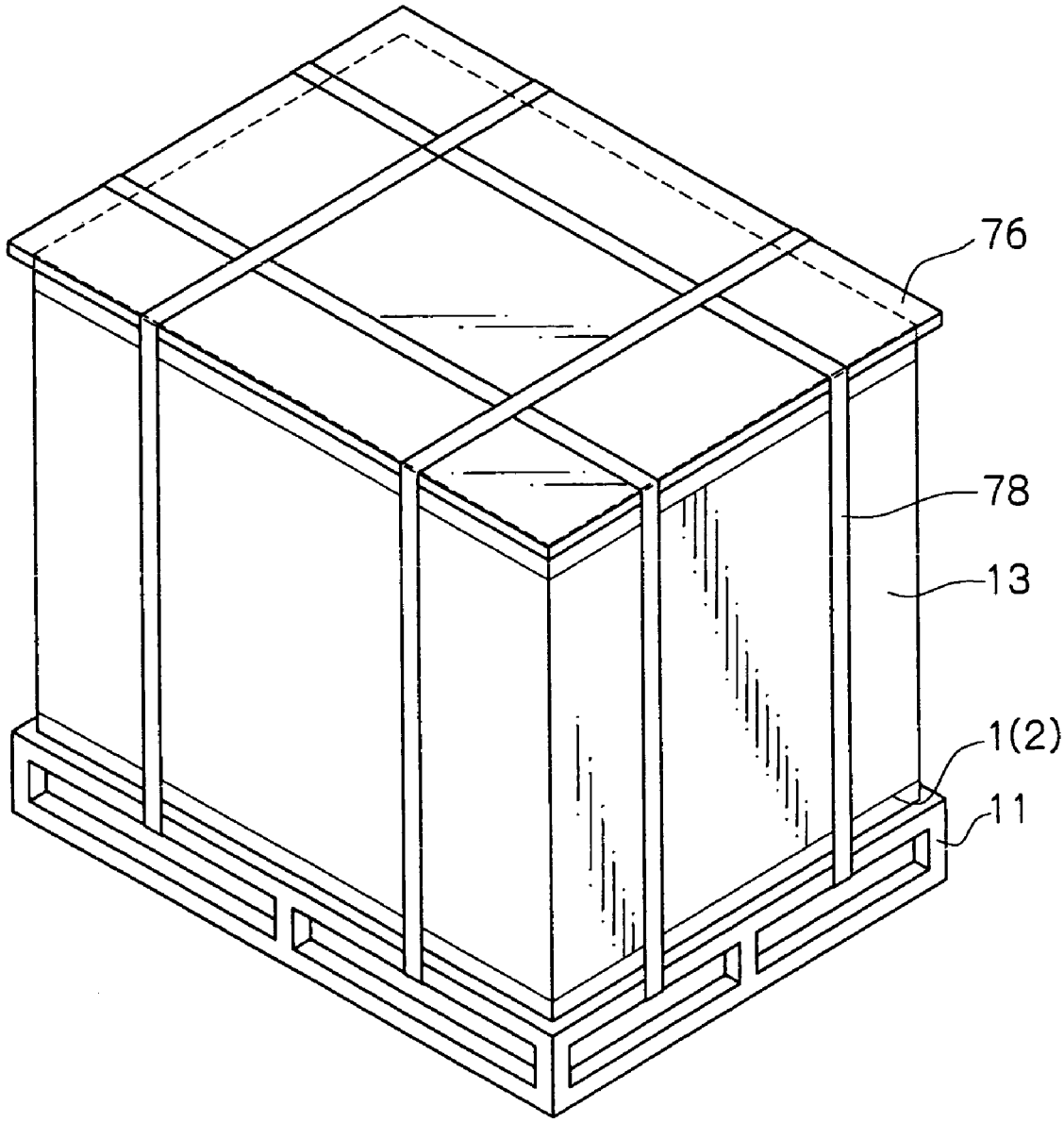
FIG. 8 is a perspective view showing the stack around whose side surfaces the single-faced corrugated fiberboard is wrapped by the packaging apparatus relating to the embodiment.
Figure 9:
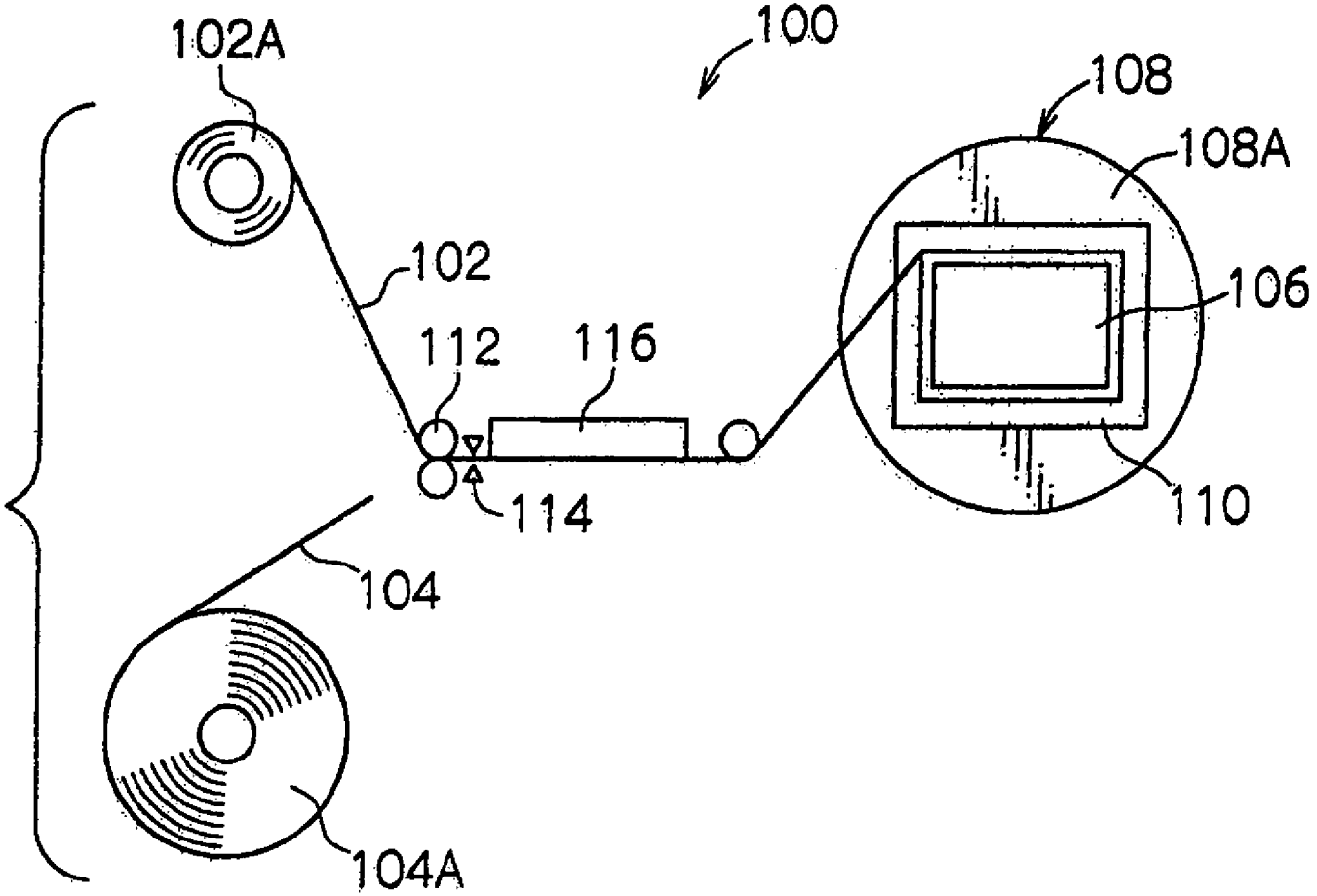
FIG.9 RELATED ART
FIG. 9 is a schematic diagram showing a packaging apparatus relating to a conventional example.

Thereafter, as shown in FIG. 8, a top plate 76 is placed on the top surface of the stack 13 around which the single-faced corrugated fiberboards 1, 2 are wrapped, and the top plate 76 is bound by binding bands 78, and this bound structure is shipped out.

Note that, in the present embodiment, a packaging apparatus, which wraps a single-faced corrugated fiberboard around the side surfaces of stacked planographic printing plates, is described as an example. However, the present invention is not limited to the same, and can be applied to various other types of loaded objects.

Because the present invention is structured as described above, the trailing end of a preceding packaging material and the leading end of a subsequent packaging material can be easily joined together, and the preceding packaging material can be used up until the end thereof. Therefore, there is no waste of the preceding packaging material.

What is claimed is:

1. A packaging method for drawing a packaging material out from a packaging material roll in which the packaging material is wound-up in a form of a roll, and wrapping the packaging material around side surfaces of a loaded object which is loaded on a pallet, the packaging method comprising:

detecting that a remaining length of the packaging material has become shorter than a length needed to wrap around the side surfaces of the loaded object;

after the detecting, stopping the wrapping of the packaging material around the side surfaces of the loaded object;

increasing an amount of the drawn-out packaging material trained on accumulating rollers comprising a set of fixed and reserve rollers by moving the reserve roller away from the fixed roller;

fixing the reserve roller and stopping drawing-out of the packaging material, when a trailing end of the packaging material is drawn out to a joining position at which the trailing end of the packaging material is joined together with a leading end of a subsequent packaging material;

joining together the trailing end of the packaging material and the leading end of the subsequent packaging material; and after the joining, starting wrapping of the packaging material onto the side surfaces of the loaded object and drawing-out of the subsequent packaging material from a packaging material roll.

2. The packaging method of claim 1, further comprising of providing the accumulating roller to be oriented vertically.

* * * * *